US007440579B2

(12) United States Patent
Vonlanthen

(10) Patent No.: US 7,440,579 B2
(45) Date of Patent: Oct. 21, 2008

(54) HEARING DEVICE HAVING TWO MODULES FOR ASSEMBLING/DISASSEMBLING DEVICE

(75) Inventor: Andy Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 11/677,466

(22) Filed: Feb. 21, 2007

(65) Prior Publication Data

US 2007/0133833 A1 Jun. 14, 2007

Related U.S. Application Data

(62) Division of application No. 10/008,280, filed on Nov. 8, 2001, now Pat. No. 7,194,101.

(51) Int. Cl.
*H04R 25/00* (2006.01)

(52) U.S. Cl. ..... 381/322; 381/324

(58) Field of Classification Search ..... 381/312, 381/315, 322–324, 328, 330; 379/430; 455/90.2
See application file for complete search history.

(56) References Cited

U.S. PATENT DOCUMENTS

| | | | |
|---|---|---|---|
| 3,659,056 | A | 4/1972 | Morrison |
| 4,723,293 | A | 2/1988 | Harless |
| 5,701,348 | A | 12/1997 | Shennib |
| 5,825,896 | A | 10/1998 | Leedom |
| 6,021,207 | A | 2/2000 | Puthuff |

FOREIGN PATENT DOCUMENTS

| | | | |
|---|---|---|---|
| WO | 0004743 | A1 | 1/2000 |
| WO | 0032009 | A2 | 6/2000 |
| WO | 00 79834 | A1 | 12/2000 |
| WO | 0079836 | A1 | 12/2000 |

OTHER PUBLICATIONS

Translation of Japanese Office Action dated Apr. 8, 2008 in foreign counterpart application.

*Primary Examiner*—Suhan Ni
(74) *Attorney, Agent, or Firm*—Pearne & Gordon LLP

(57) ABSTRACT

A hearing device is provided with an electrical supply unit and an electrical to mechanical converter incorporated in a first module. An acoustical to electrical converter and a signal processing unit are incorporated in a second module. The first and second modules are assembled so that they can be easily disassembled.

10 Claims, 4 Drawing Sheets

HEARING DEVICE HAVING TWO MODULES FOR ASSEMBLING/DISASSEMBLING DEVICE

BACKGROUND OF THE INVENTION

The present invention is directed on a hearing device, a set of such devices, a method for manufacturing a hearing device and a method for upgrading such an existing hearing device.

When we speak of hearing devices we understand under such devices on one hand hearing aid devices that are therapeutical devices for improving hearing ability of individuals, primarily according to diagnostic results. Such hearing aid devices may be Outside-The-Ear hearing aid devices or In-The-Ear hearing aid devices. Nevertheless we also understand under the term hearing device such devices which may improve hearing of normal hearing individuals e.g. in specific acoustical situations as in a very noisy environment or in concert halls, or which may even be used in context with remote communication or with audio listening for instance, as provided by headphones.

SUMMARY OF THE INVENTION

All the hearing devices which are addressed by the present invention are so-called active hearing devices which comprise at least one acoustical to electrical converter, as a microphone, at the input side, at least one electrical to mechanical converter at the output side, for instance a loudspeaker and which further comprise a signal processing unit for processing signals according to the output signals of the acoustical to electrical converter and for generating output signals to the electric input of the electrical to mechanical output converter.

The device further comprises an electrical power supply for those units which have to be electrically supplied as especially for the signal processing unit.

Hearing devices of one type as for instance and especially In-The-Ear or outside-The-Ear hearing aid devices are today manufactured for different levels of signal transmission power at the electrical to mechanical converter. According to these levels of transmission power the addressed hearing devices are construed as accordingly different and tailored hearing devices.

Departing from a hearing device with at least one acoustical to electrical converter, at least one electrical to mechanical converter, at least one signal processing unit and with an electrical supply unit it is an object of the present invention to provide utmost flexibility with respect to construing such a hearing device with the desired level of transmission power. This is realized at the said hearing device by providing a first module with the electrical supply unit and with the at least one electrical to mechanical converter and a second module with the signal processing unit and the at least one acoustical to electrical converter and thereby providing the first and second modules hand-disassemblably assembled.

Thereby the present invention departs from the recognition that hearing devices and thereby especially hearing aid devices as construed today and tailored for different levels of transmission power differ especially with respect to volume and power of the power supply and of the electrical to mechanical converter. Signal processing units as well as acoustical to electrical converters are thereby in fact unaffected by the respectively selected level of transmission power. By providing the first module with the electrical power supply and with the at least one electrical to mechanical converter there is provided a first module of the hearing device which is dependent from the device's level of transmission power. The second module wherein the signal processing unit on one hand and the acoustical to electrical converter is integrated, is not independent from the said power. Thus the hearing device according to the invention is formed by a power level independent second module and by a power level dependent first module.

This opens the possibility to provide for entire sets of hearing devices according to the second aspect of the present invention, which set may in fact be said a "hearing device family" having set members for different transmission power levels. They do only differ with respect to that first module which is dependant from such power levels whereas the other, second module which is not dependant therefrom is all the same for all members of such a set.

Thus there is proposed a set of hearing devices each with at least one acoustical to electrical converter, at least one electrical to mechanical converter, at least one signal processing unit and an electrical power supply unit wherein the electrical power supply unit and the electrical to mechanical converter of each of the hearing devices are provided in a first module, the acoustical to electrical converter and the signal processing unit are provided in a second module and whereat respective first and second modules are manually disassemblably assembled at each of the hearing devices. Thereby the hearing devices have different acoustical to mechanical transmission power. The second modules of each of the hearing devices of the set are the same modules and the first modules of each of said hearing devices of the set are different modules.

Under a further aspect of the present invention, the concept according to the present invention opens a most advantageous possibility of manufacturing hearing devices for different transmission powers. This is accomplished by the method according to the present invention for manufacturing a hearing device which comprises

- Assembling an electric power supply and an electrical to mechanical converter to a first module
- Assembling an acoustical to a electrical converter and a signal processing unit to a second module and
- Releasably assembling the first and second modules.

Thereby the most advantageous possibility is opened to manufacture for a complete family of hearing devices with family members of different transmission power lent with the same second modules and to assemble, during manufacturing, the same unique second modules with power adequate second modules comprising the power supply and the electrical to mechanical converter. It goes without saying that by such modular concept manufacturing of different hearing devices with respect to transmission power becomes most economical.

Under a still further aspect of the present invention the overall concept still opens a further possibility, namely to most easily and, for the individual, most economical upgrade an existing hearing device once it does not anymore suffice to initially installed transmission power.

Thereby and still according to the present invention there is proposed a method for upgrading an existing hearing device for individual needs having changed, which comprises exchanging at the said hearing device exclusively a module which comprises an electrical power supply and an electrical to mechanical converter of the hearing device.

Thus the principle of the present invention under all its aspects is to subdivide the hearing device in a module which comprises the function elements which are dependent on transmission power and a module which comprises the function elements which are not dependent on the transmission power. The two modules are as was said so assembled that they may be disassembled manually or with easily handable tools whereby at least the second module which is independent of transmission power is not destroyed.

In a preferred embodiment of the invention under all its aspects with respect to hearing devices, a set of such devices, manufacturing or upgrading methods, the electrical to mechanical converters and the electrical power supply are provided unremovable within the first module which first module is thus conceived as an exchange part.

If the power supply unit is realized by one or more than one battery thus this preferred embodiment results in exchanging the battery at the said first module, together with the electrical to mechanical converter by exchanging the integral first module.

A further preferred embodiment of the present invention under all the aspects as mentioned provides an On/Off control arrangement for switching the hearing device on and off at the first module, i.e. at that module which comprises the power supply and the electrical to mechanical converter.

Further in a preferred embodiment of the present invention under all its aspects, the second module, i.e. the module which comprises signal processing unit and acoustical to electrical converter, which is thus independent of transmission power has a program control unit which is operationally connected to the signal processing unit in the second module.

In a further preferred embodiment of the present invention under all its aspects the addressed hearing device is a hearing aid device being an Outside-The-Ear hearing device or an In-The-Ear hearing device.

In a further embodiment of the present invention still under all its aspects the power supply unit is realized by one of at least one battery and of at least one rechargeable power supply unit.

In a further preferred embodiment of the present invention under all its aspects the power supply unit is separably removable from the first module so that one can replace the power supply at the first module itself.

It has to be noted that when e.g. upgrading an existing hearing device according to the present invention by exchanging its first module by a further first module which is adapted to higher or lower power transmission, normally the settings of the second processing unit may be at least substantially kept unchanged because with changing transmission power the signal transmission characteristics as with respect to frequency characteristics etc. may be kept unchanged.

BRIEF DESCRIPTION OF THE DRAWINGS

The present invention under all its aspects shall now be described by way of examples and with help of figures. They show.

DETAILED DESCRIPTION OF EXAMPLE EMBODIMENTS OF THE INVENTION

Figure 1:
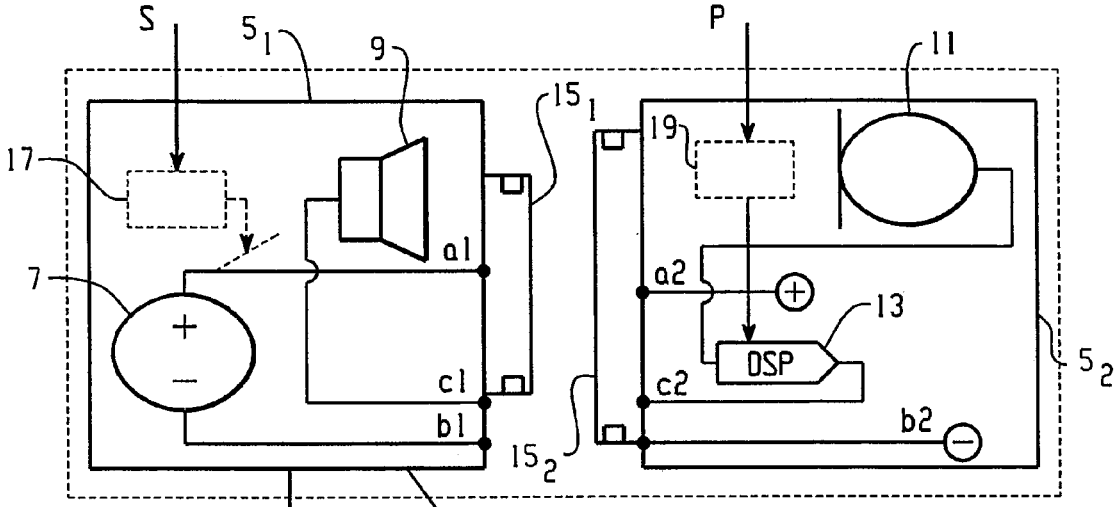
FIG. 1 In a schematic and simplified representation form, a hearing device according to the present invention being possibly a member of a set of hearing devices according to the present invention and manufactured or possibly upgraded according to the present invention.

In FIG. 1 there is shown within the dotted line frame a hearing device 1 according to a first embodiment of the present invention. The hearing device 1 substantially consists of a first module $\mathbf{5}_1$ and of a second module $\mathbf{5}_2$. The first module $\mathbf{5}_1$ comprises an electrical power supply 7, be it one or more than one battery, especially a Zinc-Air battery or be it a rechargeable accumulator.

Further the first modules $\mathbf{5}_1$ comprises an electrical to mechanical output converter 9 of the hearing device shown as a loudspeaker.

The second module $\mathbf{5}_2$ of the hearing device 1 according to the present invention incorporates at least one acoustical to electrical input converter 11 and a signal processing unit 13, normally a digital signal processing unit D S P.

The two modules $\mathbf{5}_1$ and $\mathbf{5}_2$, which substantially form the hearing device 1, are disassemblably assemblable, which means they may be manually assembled and disassembled or may at least be assembled and disassembled by making use of any kind of tools, as e.g. of screwdrivers. Both modules or at least the second module $\mathbf{5}_2$ are not destroyed by disassembling. Easy assembling and disassembling may e.g. be realized by respective bayonet link parts $\mathbf{15}_1$ and $\mathbf{15}_2$, respectively provided at the two modules $\mathbf{5}_1$ and $\mathbf{5}_2$. It goes without saying that for the skilled artisan a huge number of different possibilities are present, how to assemble two modules so that they may easily be disassembled again, without that at least one of the two modules, namely module $\mathbf{5}_1$ is destroyed.

Further, it must be emphasized that in spite of the fact that throughout the description of the present invention we refer to the hearing device being substantially formed by the two modules, it goes without saying that further modules may be provided at the hearing device, as e.g. at an Outside-The-Ear hearing device the tubing to the inside of the ear channel.

As was explained above, hearing devices which are conceived for different levels of transmission power do vary with respect to their power supply 7 and their electrical to mechanical converter 9, and thus normally by none of the functional elements which are incorporated in module $\mathbf{5}_2$. This second module $\mathbf{5}_2$ incorporates functional elements, namely the signal processing unit 13 and the at least one acoustical to electrical converter 11, which are the modules, in one embodiment of the invention, which are unaffected by the different levels of transmission power.

Electrical signal transmission from the power supply 7 in first module $\mathbf{5}_1$ to the functional elements, which have to be electrically fed in the second module $\mathbf{5}_2$, is realized by establishing simultaneously with assembling the two modules $\mathbf{5}_1$ and $\mathbf{5}_2$, electrical power supply contacts as schematically shown in FIG. 1 at contact $a_1$, $b_1$ and $a_2$, $b_2$.

The same is valid with respect to operationally connecting the output of the signal processing unit 13 in module $\mathbf{5}_2$ to the input of electrical to mechanical converter 9, as is shown in FIG. 1 by the contacts $c_1$ and $c_2$.

In a preferred mode of the hearing device according to the present invention and respectively of a member of a set of hearing devices according to the present invention and further respectively of a manufacturing method according to the present invention and of an upgrading method according to the present invention On/Off switching of the hearing device and the respective control arrangement is provided in the first module $\mathbf{5}_1$ as shown in FIG. 1 by external input S to the On/Off switching unit 17 shown in dashed lines and controlling e.g. power supplying the functional elements which need electrical power supply.

In analogy and under all aspects of the present invention, externally controlling signal processing as e.g. selecting different processing programs and the respective control units are provided at the second module $\mathbf{5}_2$, as is schematically shown in FIG. 1 by external input P acting on a respective control unit 19 for signal processing unit 13.

Figure 2A:
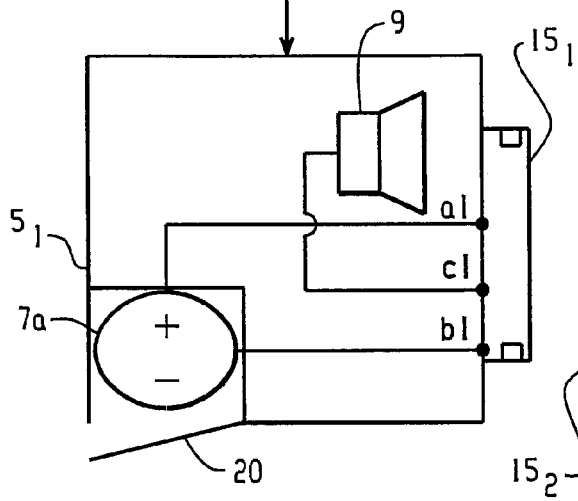
FIG. 2*a* a first realization form of a first module of the hearing device according to FIG. 1.

Turning to the specific realization form of module $\mathbf{5}_1$, i.e. that module which varies in dependency of transmission power to be realized at a specific hearing device, According to FIG. 2*a*, which shows a first preferred embodiment of the first module $\mathbf{5}_1$, the power supply 7*a*, as e.g. one or more than one batteries, is exchangeable from the first module $\mathbf{5}_1$, as schematically shown by a. cover 20 at module $\mathbf{5}_1$, which may be opened so as to remove an old power supply 7*a* and replace it by a new one.

Figure 2B:
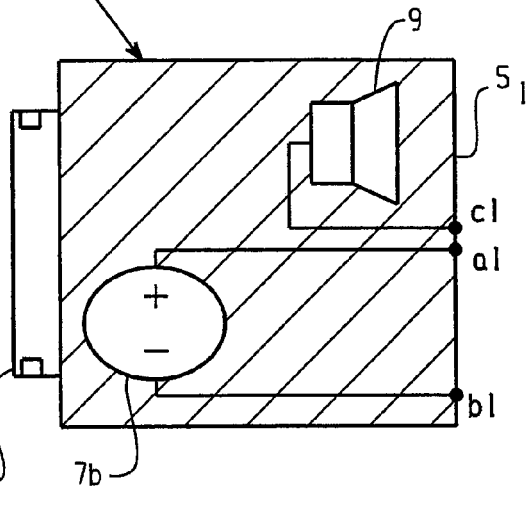
FIG. 2*b* a second preferred embodiment of a first module of a hearing device according to FIG. 1.

FIG. 2*b* as well shows an embodiment, i.e. a second preferred embodiment of first module $\mathbf{5}_1$. Here the power supply 7*b*, as well as the electrical to mechanical converter 9 are fully integrated within module $\mathbf{5}_1$, i.e. they may not be removed without destroying such module $\mathbf{5}_1$. Thus, e.g. the electrical to mechanical converter 9 as well as the power supply 7*b* are moulded integrally to form the first module $\mathbf{5}_1$.

Figure 3:
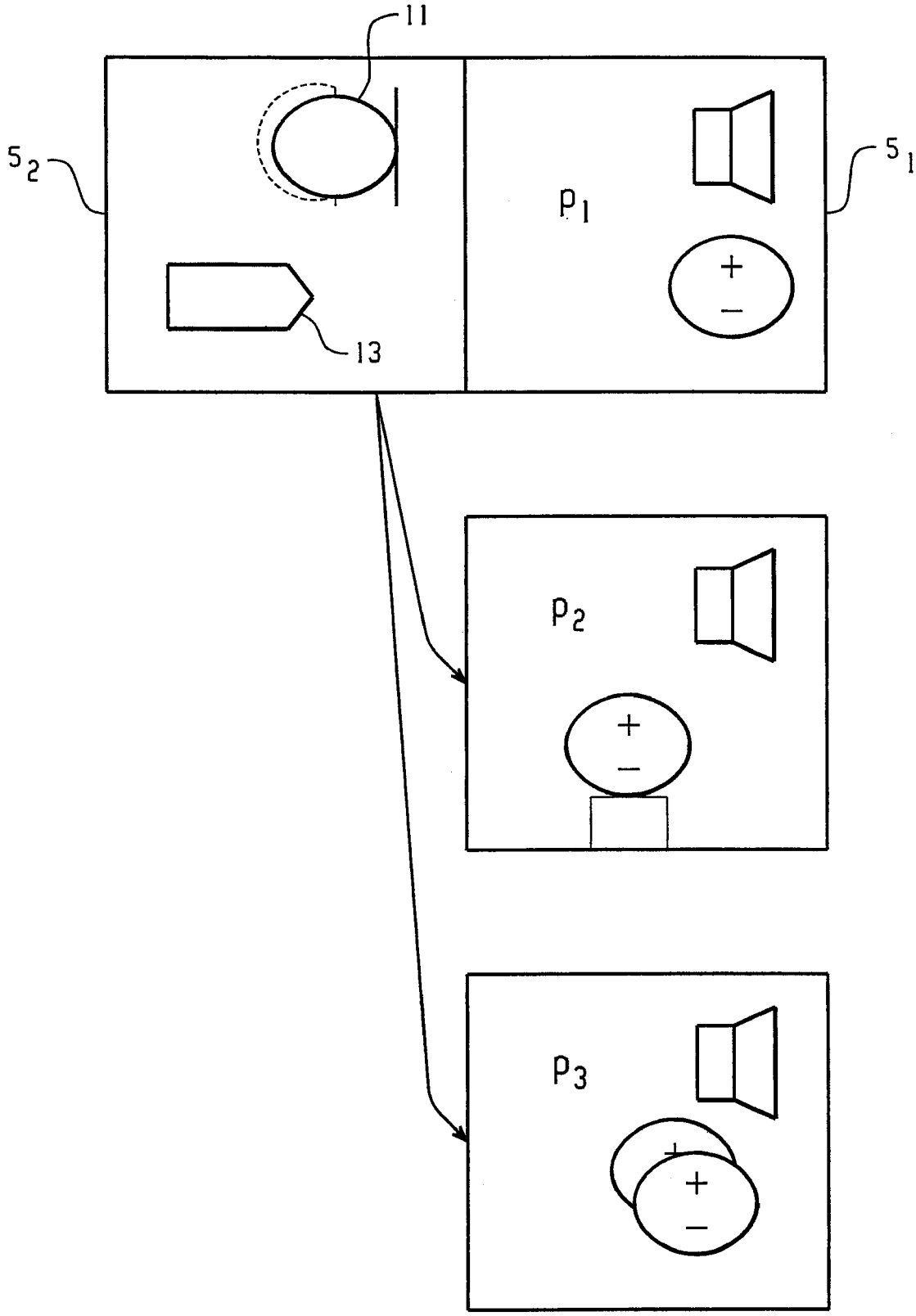
FIG. 3 in a representation according to that of the FIGS. 1 or 2 schematically proceeding of manufactured or of upgrading a hearing device according to the present invention.

In FIG. 3 there is explained the inventive manufacturing method and/or the inventive upgrading method. A single second module $\mathbf{5}_2$ incorporates the signal processing unit 13 as well as one or more than one acoustical to electrical converters 11. The respective interconnections, which have been shown and explained with the help of FIG. 1, are not shown in this fig. For manufacturing a hearing device according to the present invention there is provided a series of identical second modules $\mathbf{5}_2$. According to the specifically needed transmission power levels $P_1$, $P_2$, $P_3$ there is then assembled with each of the said second modules $\mathbf{5}_2$ a first module $\mathbf{5}_1$ as shown. Thus, e.g. for conceiving an inventive set of hearing devices with a hearing device member for transmission power $P_1$, a second hearing device member for a second transmission power level $P_2$ etc., there are provided three identical second modules $\mathbf{5}_2$, and to each of these three identical second modules $\mathbf{5}_2$ there is assembled a respective first module $\mathbf{5}_1$, which is respectively tailored for the desired power transmission levels.

Thus, in manufacturing, for a variety of different hearing devices—as a family of such devices—one kind of power-independent module $\mathbf{5}_2$ is manufactured, which is assembled according to power needs with one of the power-specific first modules $\mathbf{5}_1$.

Turning now to inventive upgrade of an existing hearing device, it becomes clear that whenever an individual's hearing device has to be updated with respect to transmission power P, the second modules $\mathbf{5}_2$ of that individual hearing device is kept unchanged and only the first module $\mathbf{5}_1$, i.e. that one which is conceived in function of desired transmission power P, is exchanged.

Figure 4:
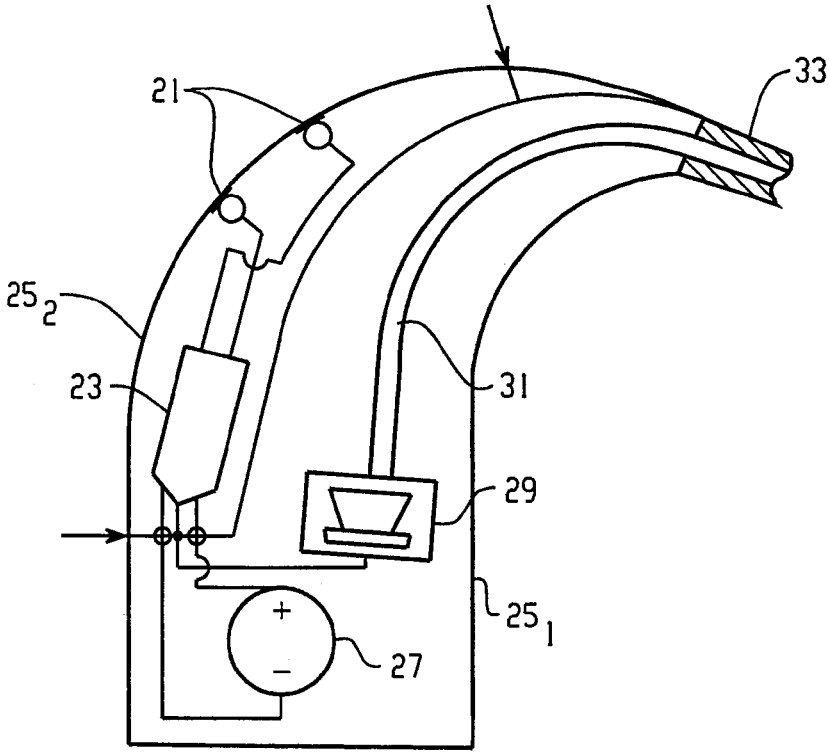
FIG. 4 still in a simplified and schematical representation shows a hearing device according to the present invention realized as a hearing aid device, namely an Outside-The-Ear hearing aid device.

In FIG. 4 there is schematically shown an Outside-The-Ear hearing aid device according to the present invention, which is manufactured or upgraded according to the present invention and which may be one member of a set or a family of hearing aid devices according to the present invention. The first module $\mathbf{25}_1$, incorporates the possibly exchangeable power supply unit 27 as well as the electrical to mechanical converter 29 realized by an output microphone. By means of an acoustical tubing link 31 the output side of the microphone 29 is fed to an output connection tubing 33 to be connected to the inside of individual's ear channel as is well known in this art. The second module 252 incorporates the signal processing unit 23 as well as at least one, as shown in FIG. 4 a pair of acoustical to electrical converters 21.

All the embodiments as discussed with the help of FIGS. 1 and 2 may be realized also for this hearing device as shown in FIG. 4, i.e. power supply 27 may be removable from the first module $\mathbf{25}_1$r in another embodiment the power supply 27 as well as electrical to mechanical converter 29, all the tubing 31 and (see FIG. 1) On/Off control units may be incorporated in first module $^{25}{}_1$ unremovable, as e.g. integrally moulded to such a module, so that whenever one part of that module $\mathbf{25}_1$ is defective, the complete module $\mathbf{25}_1$, is replaced and may not be repaired.

Accordingly, all the embodiments with respect to second module $\mathbf{25}_2$, which were described may be incorporated in the device according to FIG. 4 too, i.e. external inputs to the signal processing units 23, at second module $\mathbf{25}_2$. Slightly bent top corner module $\mathbf{25}_2$ may e.g. be snapped onto power specific first module $\mathbf{25}_1$, whereby by such assembling and as shown in FIG. 4 the electrical interconnections between the two modules $\mathbf{25}_1$ and 252 are established.

Figure 5:
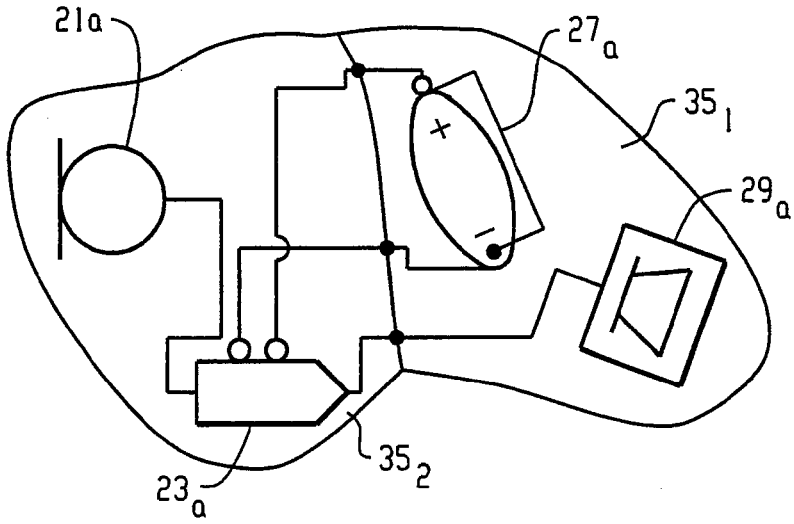
FIG. 5 shows still in a simplified and schematical representation form a hearing device according to the present invention, realized as a hearing aid device, namely an In-The-Ear hearing aid device which may be one member of a set of such hearing aid devices according to the present invention, has been manufactured or may be upgraded according to the respective manufacturing or upgrading methods of the present invention.

In FIG. 5 there is again schematically shown a hearing device according to the present invention realized as an In-The-Ear hearing aid device. The two modules $\mathbf{35}_1$, and $\mathbf{35}_2$ are again separably assembled, as e.g. by screwing, by a bayonet link, by a snapping action link etc. After the explanations with respect to FIGS. 1 to 4 the realization as shown in FIG. 5 is perfectly clear to the skilled artisan, and no additional explanations are necessary.

According to the description as it was given up to now it was assumed, according to one embodiment of the present invention, that when changing the requirement of the inventive hearing device from one power level to the other, besides of the electrical to mechanical output converter and the power supply no further adjusting requirements are needed, i.e. at one and the same inventive hearing device by merely exchanging power supply and electrical to mechanical output converter provided in one module, different power requirements may be met.

In a further embodiment of the present invention this condition is loosened in that sense that some electronic stages, as e.g. and especially output amplifier stages, which drive the electrical to mechanical output converter, have to be accordingly adapted if the output power level of a hearing device is changed. Further, it might be that changing the electrical to mechanical output converter and possibly even changing the power supply may require additional adjustments at the electronics as built into the second module $\mathbf{5}_2$ as of the description above. Thus, with the help of the following figures further preferred embodiments of the inventive hearing device shall be described, whereat, principally, there occurs automatic adaptation of electronics requirements to changing power requirements, which latter are fulfilled by exchanging, according to FIG. 1, module $\mathbf{5}_1$ of the device.

The preferred further embodiments as will be described now are shown in a representation according to that of FIG. 1, whereby the explanations, which were given with respect to the FIGS. 2 to 5, remain valid, if a hearing device according to that of FIG. 1 is replaced by a hearing device as will be explained with the help of the FIGS. 6 and 7. Thereby the hearing devices as of the FIGS. 6 and 7 clearly also fulfill the requirements as necessitated for the inventive set of hearing devices, the inventive method for manufacturing such devices as well as for the inventive method of upgrading such hearing devices.

Figure 6:
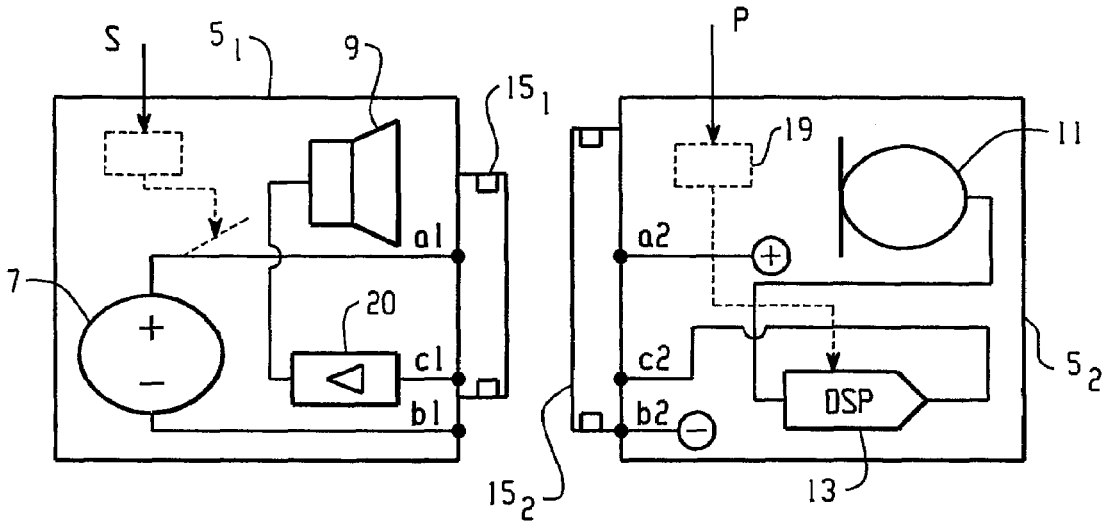
FIG. 6 in a schematic and simplified representation form, a hearing device according to the present invention, being possibly a member of a set of hearing devices according to the present invention and manufactured or possibly upgraded according to the present invention and in a further preferred embodiment, and FIG. 7 in a schematic and simplified representation form according to that of the FIG. 6 or 1, a further preferred hearing device according to the present invention, being possibly a member of a set of hearing devices according to the present invention and manufactured or possibly upgraded according to the present invention.

According to FIG. 6 the power-specific module $\mathbf{5}_1$ as that of FIG. 1 comprises the electrical mechanical output converter 9, the power supply 7 as was described with the help of FIG. 1. The second module $\mathbf{5}_2$, in fact the transmission power independent module of the inventive hearing device as of FIG. 1, is, compared with that of FIG. 1, unchanged. Nevertheless, in this embodiment the power-specific first module $\mathbf{5}_1$ comprises all the electronics, which has to be adapted to the respective power. As shown in FIG. 6 there is provided in that module $\mathbf{5}_1$ as a specific example of electronics, which possibly has to be adapted to a more or less powerful electrical to mechanical output converter 9, a respectively power-specific output stage 20. Thus, again all units, which have to be adapted whenever power requirements are changed from a first level to a second level, are incorporated in the power-specific first module $\mathbf{5}_1$.

Thereby, again, for an inventive set of hearing devices the modules $\mathbf{5}_2$ of all such family—or set-members remain identical, whereas the modules $\mathbf{5}_1$ are different for different power requirements to that members and the electronic modules, which have to be adapted to the respective power levels, are integrated in the first module $\mathbf{5}_1$.

Figure 7:
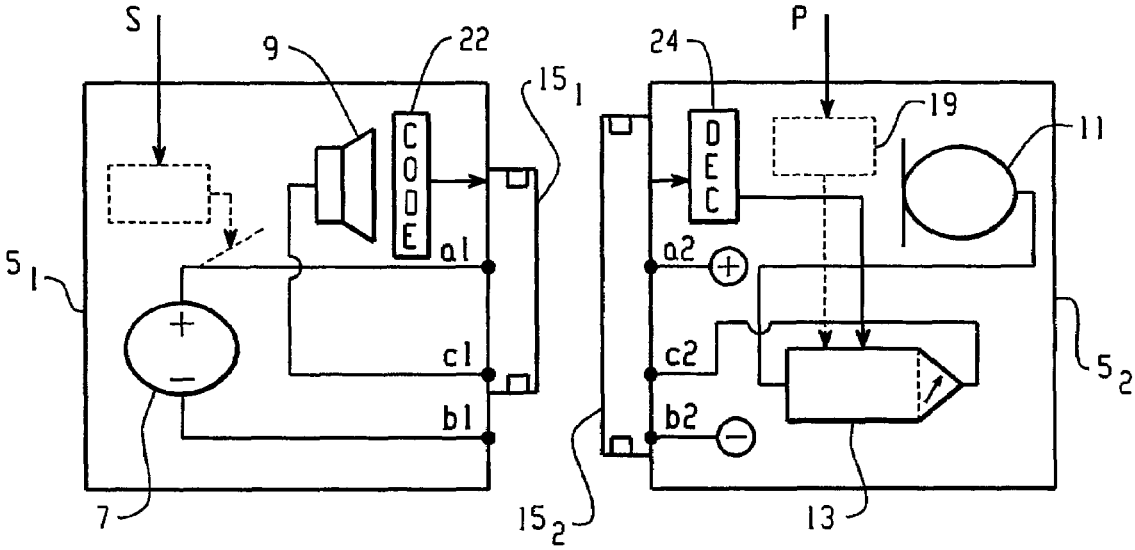

According to FIG. 7 a further preferred embodiment of the inventive hearing device is shown in a representation according to that of FIG. 1 or FIG. 6, for which all the explanations of the FIGS. 2 to 5 are still valid as an inventive hearing device according to FIG. 1 is replaced by a hearing device according to FIG. 7. Such hearing device forms again the basis for realizing the inventive set of hearing devices, the inventive method for manufacturing as well as the inventive method for upgrading.

According to FIG. 7 the first module $\mathbf{5}_1$, which is the power level specific module, comprises additionally to the embodiment as shown in FIG. 1 a code unit 22 under its most generic aspect. Such a code unit 22 defines for a code, which is indicative for the specific power level for which module $\mathbf{5}_1$ is designed and thus, respectively, for the specific electrical to mechanical output converter 9 and power supply 7. Under its most generic aspect such a code unit 22 may be formed by an electronic memory, especially by a read-only memory element, or may be formed by specific arrangements of mechanical embossments and projections, thus by any means which may be conceived to identify one of several codes and thus situations.

Accordingly, the second module $\mathbf{5}_2$ comprises, additionally to the units as described in module $\mathbf{5}_2$ of FIG. 1, a reader and decoder unit 24, which is adapted to the coder unit 22 and which is able to read or detect the power level specific code of that first module $\mathbf{5}_1$ which is assembled to the module $\mathbf{5}_2$.

The output of the reader and decoder unit 24 controls all electronic units in module $\mathbf{5}_2$, which have to be adjusted and adapted according to the respectively provided first module $\mathbf{5}_1$ and thus according to the respectively applied transmission power level. Thus, the output of reader and decoder unit 24 e.g. adjusts output power or gain of an output amplifier stage or booster and/or possibly adjusts the signal transfer function as of a filter function in the DPS unit 13, so e.g. according to respective characteristics of the electrical to mechanical output converter 9, which may vary from converter to converter conceived for different output power levels.

Thus, whenever a power-specific module $\mathbf{5}_1$ is plugged on a module $\mathbf{5}_2$, the module $\mathbf{5}_2$ recognizes by reading the code which kind of first module $\mathbf{5}_1$ is plugged on and accordingly adjusts those electronic units, which have to be adjusted as a function of transmission power.

The invention claimed is:

1. A set of hearing devices, each with at least one acoustical to electrical converter, at least one electrical to mechanical converter, at least one signal processing unit and an electrical power supply unit wherein said electrical power supply unit and said electrical to mechanical converter of each of said hearing devices are incorporated in a first module, said acoustical to electrical converter as well as said signal processing unit are incorporated in a second module, said respective first and second module being assembled in a disassemblable manner at each of said hearing devices, said hearing devices having different acoustical to mechanical transmission powers, said second modules of said hearing devices being the same modules, and said first modules of said hearing devices being different modules.

2. The set according to claim 1, wherein at least one first module of a hearing device of said set has an electrical power supply unit and an electrical to mechanical converter, which are unremovably integrated in said first module, said respective first module being integrally an exchange part.

3. The set according to claim 1 or 2, wherein a first module of at least one of said hearing devices forming said set has an On/Off control arrangement for said respective hearing device.

4. The set according to claim 1, wherein at least one second module of said hearing devices belonging to said set has a control arrangement for externally controlling said signal processing unit.

5. The set according to claim 1, wherein said hearing devices forming said set being hearing aid devices and thereby one of In-The-Ear hearing aid devices and Outside-The-Ear hearing aid devices.

6. The set according to claim 1, wherein at least one of said first modules of said hearing devices comprises a power supply unit, which is a rechargeable accumulator.

7. The set according to claim 1, wherein at least one of said first modules comprises a power supply, which is at least one battery.

8. The set according to claim 1, wherein at least one of said first modules has a power supply unit, which is exchangeable from said first module.

9. The set according to one of the claim 1, said first modules having a code unit with a code, said codes of said first modules being different, said second modules having a code reader and decoder unit for reading and decoding said code of said first modules, the output of said code reader and decoding unit being operationally connected to at least one adjusting input of an electronic unit within said second module.

10. The set according to one of the claim 1, further comprising an electronic unit respectively within said first modules and wherein said electronic units of said first modules are different.

* * * * *